United States Patent [19]

Balass

[11] Patent Number: 4,741,487

[45] Date of Patent: May 3, 1988

[54] APPARATUS FOR WINDING A CONTINUOUSLY ARRIVING IMBRICATED FORMATION OF FLEXIBLE FLAT STRUCTURES INTO A WOUND PRODUCT PACKAGE

[75] Inventor: Valentin Balass, Zürich, Switzerland

[73] Assignee: Ferag AG, Hinwil, Switzerland

[21] Appl. No.: 5,693

[22] Filed: Jan. 22, 1987

[30] Foreign Application Priority Data

Jan. 27, 1986 [CH] Switzerland ..... 298/86

[51] Int. Cl.[4] ..... B65H 75/00

[52] U.S. Cl. ..... 242/59; 242/66; 242/67.1 R

[58] Field of Search ..... 242/59, 65, 66, 67.1 R, 242/67.2, 55; 53/118

[56] References Cited

U.S. PATENT DOCUMENTS 3,563,486 2/1971 Mecussen ..... 242/67.1 R
4,651,941 3/1987 Muller ..... 242/59

FOREIGN PATENT DOCUMENTS 822769 11/1951 Fed. Rep. of Germany .
6608411 8/1971 Fed. Rep. of Germany .
2544135 11/1982 Fed. Rep. of Germany .

*Primary Examiner*—David Werner
*Attorney, Agent, or Firm*—Werner W. Kleeman

[57] ABSTRACT

A winding core and a wound product package to be formed thereon are rotatably mounted on a core bearing or support arrangement. A conveyor defining a product conveying path tangentially delivers the arriving imbricated formation to the winding core or to the wound product package formed thereon. The winding core or the wound product package formed thereon, as the case may be, is driven at a circumferential speed which substantially corresponds to the conveying speed of the product conveying path. At least one pair of driven friction wheels is positioned such that it does not drive the winding core or the wound product package formed thereon, as the case may be, at its outermost circumference or peripheral surface. To that end the at least one pair of driven friction wheels positionally adjustably engage at the flat lateral sides or end faces of the winding core or at the flat lateral sides or end faces of the wound product package wound thereon in the vicinity of the circumference thereof at mutually axially opposite situated locations.

22 Claims, 4 Drawing Sheets

APPARATUS FOR WINDING A CONTINUOUSLY ARRIVING IMBRICATED FORMATION OF FLEXIBLE FLAT STRUCTURES INTO A WOUND PRODUCT PACKAGE

CROSS-REFERENCE TO RELATED PATENTS

This application is related to the following commonly assigned U.S. Pat. Nos.: 4,532,750, granted Aug. 6, 1985, 4,587,790, granted May 13, 1986, 4,575,988, granted Mar. 18, 1986, 4,525,982, granted July 2, 1985, 4,508,523, granted April 2, 1985, 4,528,798, granted July 16, 1985, 4,595,192, granted June 17, 1986, 4,606,173, granted Aug. 19, 1986, 4,593,865, granted June 10, 1986, 4,589,606, granted May 20, 1986, 4,597,541, granted July 1, 1986 and 4,601,436, granted July 22, 1986.

BACKGROUND OF THE INVENTION

The present invention broadly relates to a new and improved apparatus for winding a continuously arriving imbricated formation or stream of flexible flat structures or articles, especially folded printed products, into a wound product package.

In its more particular aspects, the present invention concerns an apparatus for winding a continuously arriving imbricated formation or stream of flexible flat structures or products, especially folded printed products into a wound product package upon a winding core or mandrel which is rotatably mounted in a core bearing or support arrangement. The winding apparatus is provided with delivery or conveyor means defining a product conveying path for tangentially delivering or infeeding the imbricated formation or stream to the winding core or mandrel or to the wound product package formed thereon, as the case may be. There is also provided a drive or drive means for frictionally driving the wound product package at the region of its circumference or periphery.

Comparable apparatuses are known, for example, from the German Petty Pat. No. 6,608,411, filed May 15, 1968 and from the German Patent Publication No. 2,544,135, published Nov. 25, 1982. In such prior art apparatuses sacks, bags and similar flat workpieces but not folded printed products arriving in an imbricated formation, for example newspapers, are wound into so-called "imbricated band rolls". This observation and distinction are of significance and worthy of mention because the workpieces wound up with the previously known apparatuses are practically incompressible, whereas folded printed products constitute to a certain degree compressible structures.

In the apparatus disclosed in the aforementioned German Petty Pat. No. 6,608,411 the facility or means for frictionally driving the wound product package at the region of its circumference (briefly termed "package drive" in the following description) is constituted by a driven drum or cylinder upon which the wound product package rests due to its inherent or dead weight. The wound product package is mounted to be freely rotatable at one end of a swinging or pendulum rocker. The driving power or forces which can be transmitted with this package drive are comparatively small because the power transmission theoretically only occurs at the common generatrix situated between the outer surface of the driven drum or cylinder and that of the wound product package.

Furthermore, this drive means would not be suitable for effectively processing wound printed product packages because the risk of smearing or smudging the printing ink on the flat side or information or text-containing surface of the printed products is present by virtue of the prevailing unavoidable slip.

A further disadvantage of this prior art apparatus product package or its winding core or mandrel, as the case may be, is dependent upon the size of the outer diameter of the completed or finished wound product package. This is so because the wound product package, as already mentioned, is mounted to be freely rotatable at one end of a swinging or pendulum rocker, while the outer diameter of the completely wound or finished product package is dependent on the quantity and the thickness of the products contained in the wound product package.

With this known apparatus either a floor-bound or a ground based package lifting or elevating means is necessary for the removal of a completely wound or finished wound product package, which wound package can exhibit a very substantial weight, or there must be provided an overhead package lifting or elevating means. Such floor-bound or ground based package lifting or elevating means is adjustable to different heights of the winding core or mandrel of the wound product package. On the other hand, such overhead lifting or elevating means, in the best case, can transport the finished wound product package only to one location in the same hall or work area in which the apparatus is located, however not through door openings so that an unloading or transfer of the wound product package is necessary.

The disadvantages just mentioned are at least partially overcome by the apparatus disclosed in the aforementioned German Patent Publication No. 2,544,135 since the winding core and thus also the wound product package are freely rotatably held in stationary bearing blocks or pedestals. According to the apparatus design of the aforementioned German Patent Publication No. 2,544,135, the wound product package drive is accomplished by means of two driven pressure or drive bands which partially encircle the wound product package. It is a disadvantage of this prior art apparatus that the guiding of the driven pressure or drive bands requires an appreciable technological expenditure. This is due to the fact that this guide structure for guiding the driven pressure or drive bands must be capable of compensating the markedly changing length of the section of the driven pressure bands momentarily encircling the outer circumference of the wound product package as a function of the increasing diameter of the wound product package.

Furthermore, the wrap angle of the driven pressure or drive bands is not constant with this heretofore known apparatus. Even though the danger of smearing the print in the case of printed products is probably less with the wound product package drive of the apparatus according to the aforediscussed German Patent Publication No. 2,544,135 than with the apparatus according to the initially discussed German Petty Pat. No. 6,608,411, the danger still exists that the wound up flat structures also can be soiled during the unavoidable contamination or soiling of the driven pressure or drive bands. The removal of a completely wound or finished wound product package is also not without problems with this prior art apparatus since each driven pressure or drive band must first be released from engagement with the circumference or periphery of the wound product package.

SUMMARY OF THE INVENTION

Therefore, with the foregoing in mind, it is a primary object of the present invention to provide a new and improved construction of an apparatus for effectively winding a continuously arriving imbricated formation or stream of flexible flat structures or products, especially folded printed products, into a wound product package and which winding apparatus does not exhibit the aforementioned drawbacks and shortcomings of the prior art constructions.

Another and more specific object of the present invention aims at providing a new and improved construction of product winding apparatus of the previously mentioned type which, while retaining the advantages of a package drive which engages at the side of the circumference of the wound package in order to afford an essentially constant drive velocity or speed, nonetheless exhibits a comparatively simple construction and wherein there is positively eliminated any damage or impairment of any kind to the flat surfaces or sides of the flat structures or products due to the action of the package drive.

Yet a further significant object of the present invention aims at providing a new and improved construction of a product winding apparatus of the character described which is extremely simple in design, quite economical to manufacture, highly reliable in operation, not readily subject to breakdown or malfunction, requires a minimum of maintenance and servicing and affords protective winding up of the products or flat structures into stable wound product packages.

Now in order to implement these and still further objects of the invention, which will become more readily apparent as the description proceeds, the product winding apparatus of the present invention is manifested by the features that the drive means for driving the wound product package comprises at least one pair of friction elements, especially friction wheels. The at least one pair of friction wheels drives the product package while exerting a predeterminate tension on a winding strap or band conjointly wound up with the imbricated formation or stream. Means are provided for ensuring that the at least one pair of friction wheels positionally adjustably engage or contact the substantially flat ends or lateral end faces of the winding core or mandrel or the wound product package, as the case may be, at the vicinity or region of the package circumference or periphery and at mutually axially opposite situated locations thereof.

BRIEF DESCRIPTION OF THE DRAWINGS

The invention will be better understood and objects other than those set forth above will become apparent when consideration is given to the following detailed description thereof. Such description makes reference to the annexed drawings, wherein throughout the various figures of the drawings there have been generally used the same reference characters to denote the same or analogous components and wherein.

DETAILED DESCRIPTION OF THE PREFERRED EMBODIMENTS

Describing now the drawings, it is to be understood that to simplify the showing thereof only enough of the structure of the inventive winding apparatus for winding a continuously arriving imbricated formation or stream of flexible flat structures or products into a wound product package has been illustrated therein as is needed to enable one skilled in the art to readily understand the underlying principles and concepts of this invention.

Figure 1:
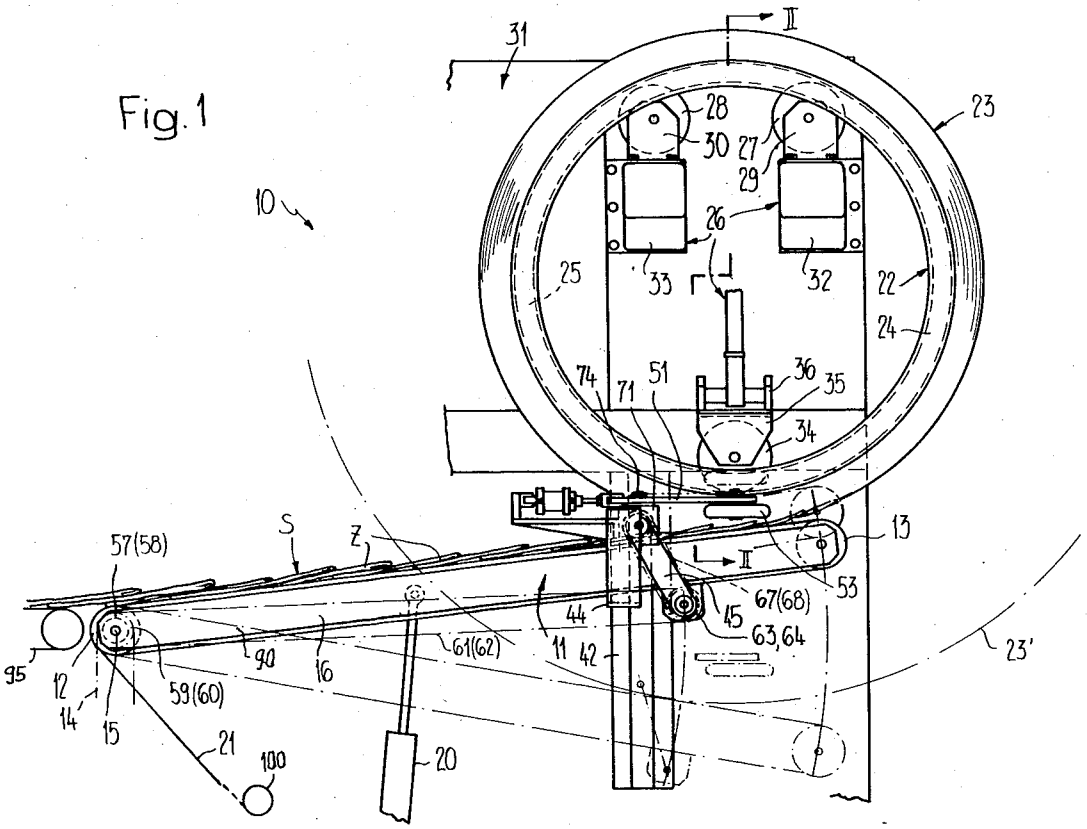
FIG. 1 schematically illustrates in side view an exemplary embodiment of a product winding apparatus wherein only the most significant component parts or elements are illustrated in order to facilitate the representation.
Figure 2:
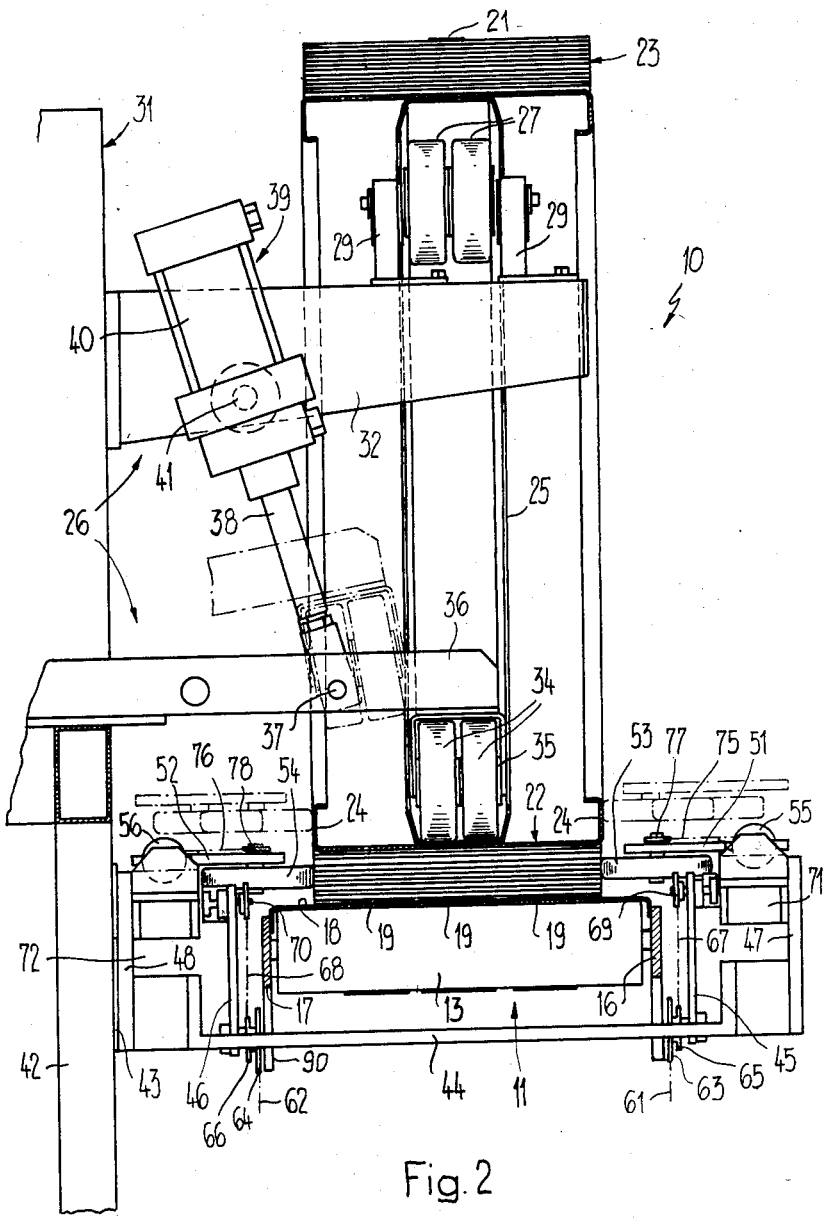
FIG. 2 schematically illustrates, on an enlarged scale and in partially sectional view, the apparatus depicted in FIG. 1, the section being taken substantially along the line II—II of FIG. 1 and wherein certain parts however are shown in front view as seen when looking from the left side of FIG. 1.
Figure 3:
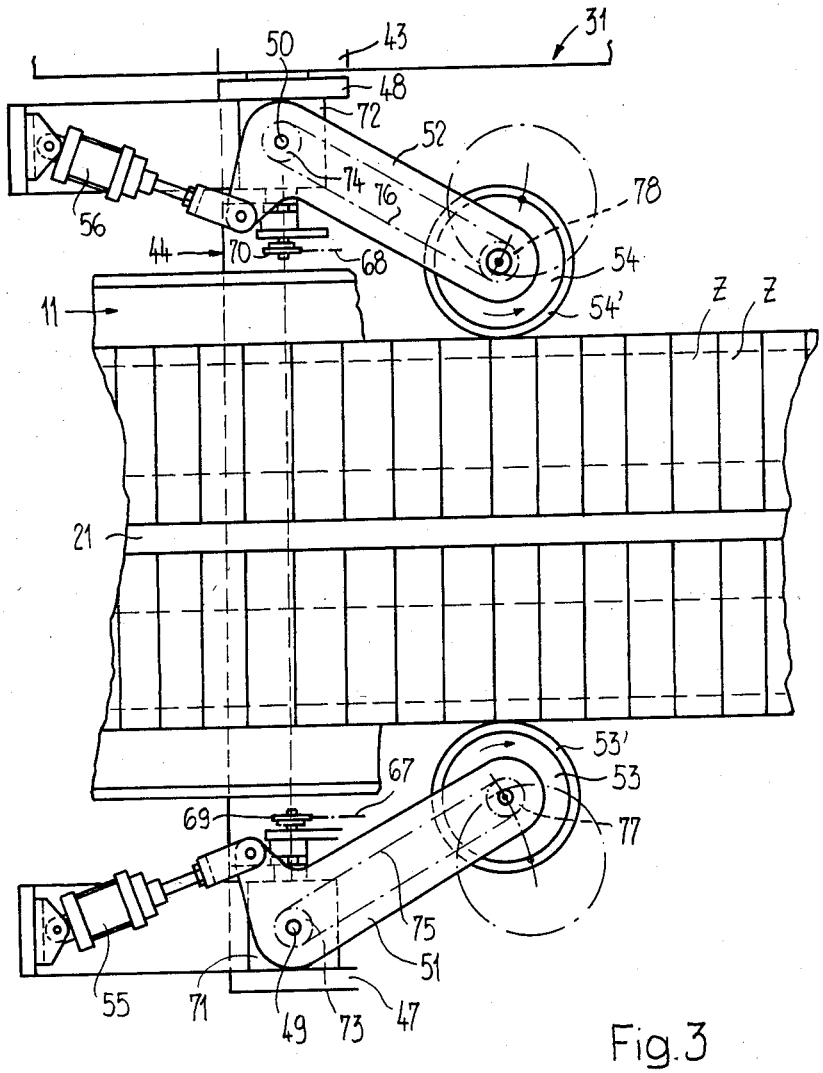
FIG. 3 schematically illustrates a plan view partially in development showing in detail that location where the friction wheels engage the winding core, wherein the winding core has been omitted to simplify the illustration.

Turning now specifically to FIGS. 1 through 3 of the drawings, the product winding apparatus 10 illustrated therein by way of example and not limitation will be seen to comprise a conveyor or conveying means 11, such as a belt or band conveyor which defines a conveying or conveyor path for the incoming products. The conveyor or conveying means 11 comprises two deflection rollers or rolls 12 and 13. The deflection roller 12 is driven for instance by means of a chain 14. The deflection rollers or rolls 12 and 13 are mounted at the ends of a rocker or swinging structure or mechanism 90. The rocker or swinging mechanism 90 is pivotable about a shaft or axis 15 of the driven deflection roller 12. The rocker or swinging mechanism 90 comprises two lateral longitudinally extending beams or structural members 16 and 17. These beams or structural members 16 and 17 are bridged or spanned at the region between the deflection rollers 12 and 13 by means of a slide surface or table 18 so that the upper effective conveying run of three belts or bands 19 (cf. FIG. 2) of the conveying means or band conveyor 11 does not experience any bending-through or deflection. A resilient or spring arrangement, for example a gas spring 20, engages the rocker or swinging mechanism 90. The gas spring 20 urges the conveyor means or band conveyor 11 upwardly, and conversely the conveying means or band conveyor 11 is pressed back against the exerted spring force by the action of the increasing size of the wound product package 23.

The conveying means or band conveyor 11 receives from a product delivery means or infeed device 95, which is only schematically indicated in the left-hand portion of FIG. 1, an imbricated formation or stream S of folded printed products, for example newspapers Z. Each folded newspaper Z overlaps the cut edges or fan edges of the preceding or leading newspaper with its leading folded or bound edge or spine. At the same time the conveying means or band conveyor 11 places a narrow winding band or strap 21 underneath the imbricated formation or stream S approximately at the region of the longitudinal center of such imbricated formation or stream S of products. The narrow winding band or strap 21 is removed from a here merely schematically illustrated but conventional braked supply reel or roll 100, as is known in this art, and wraps or trains around the driven deflection roll or roller 12. The winding band or strap 21 thus travels in a tensioned or taut condition along with the imbricated formation or stream S. The imbricated formation or stream S of the products or flat structures, here the newspapers Z, and the winding band or strap 21 conjointly arrive at the wound product package or storage coil 23 which is being formed on a winding core or mandrel 22. The circumferential or peripheral speed or velocity of the wound product package or storage coil 23 is naturally determined by the winding strap 21.

From FIG. 2 it can be seen that the annular or ring-shaped winding drum or core 22 contains at its ends two inwardly bent end or lateral flanges 24. The distance or spacing between these inwardly bent end flanges 24 corresponds approximately to the width of the newspapers Z measured transverse to the direction of conveyance of the imbricated formation or stream S. Furthermore, a circumferentially or circularly extending rail or track 25 having a substantially U-shaped inwardly opening cross-section is fixedly attached to the inner side or surface of the winding core mandrel 22 at its central region. This rail or track 25 serves, on the one hand, to radially reinforce or stiffen the relatively thin-walled winding core or mandrel 22 and, on the other hand, especially to rotatably support and to guide the winding core or mandrel 22 at a constant or fixed height in a bearing or support arrangement or winding core bearing means 26 which is described in greater detail hereinbelow.

This bearing or support arrangement 26 first of all comprises two double rollers 27 and 28. The two double rollers 27 and 28 are mounted so as to be freely rotatable in bearing pedestals or supports or blocks 29 and 30, respectively. These bearing pedestals or supports 29 and 30 are each mounted on a respective cantilever or bracket 32 and 33 laterally projecting from a lateral machine frame 31. The winding core or mandrel 22 rests in such a manner upon the double rollers 27 and 28 that these double rollers 27 and 28 engage into the open side of the track or rail 25.

The winding core bearing or support or mounting arrangement 26 comprises a further lower situated double roller 34 which is likewise mounted to be freely rotatable in a related bearing support or pedestal or block 35. The bearing support or pedestal or block 35 is mounted at the lower or underside of a cantilever or bracket 36 such that it extends downwardly. This cantilever or bracket 36 is pivotable and displaceable in relation to the machine frame 31. A piston rod 38 of a fluid-operated mechanism or unit 39 is hingedly attached or articulated to the cantilever or bracket 36 at a pivot location indicated with reference numeral 37 for pivoting the cantilever or bracket 36. A cylinder 40 of the fluid-operated mechanism 39 is suspended in a pendulum manner at a location indicated with reference numeral 41 which is disposed between the cantilevers or brackets 32 and 33.

Further means which are not particularly illustrated are provided in order to displace the cantilever or bracket 36 to a limited degree in the direction towards and away from the machine frame 31 such that the double roller or roll 34 is movable from the engagement position, which is illustrated in solid or full lines in FIG. 2 in which the double rollers 34 likewise engage in the open side of the track or rail 25, into the release position indicated in phantom or chain dotted lines in FIG. 2. Thus as should be readily evident the winding core or mandrel 22 is always freely accessible, for example by means of a fork lift truck or equivalent handling structure, from the side or end of the apparatus shown in the right hand portion of FIG. 2.

The winding core bearing or support arrangement 26 allows the winding core or mandrel 22 to be freely rotatably mounted at three spaced locations. In the engagement position the lower situated double roller 34 pushes the winding core or mandrel 22 downwards and thus prevents this winding core or mandrel 22 from lifting off of the upper situated double rollers 27 and 28.

The means are described hereinbelow which serve to rotate the winding core or mandrel 22 or the wound product package 23 formed thereon, as the case may be, such that the arriving imbricated formation or stream S is reliably and correctly wound up.

A carriage 43 provided with a cantilever or bracket 44 which spans or bridges from below the conveyor means or band conveyor 11, is suitably displaceably mounted in a guide rail 42 mounted at the machine frame 31 such that this carriage 43 can displaceably move up and down. The cantilever or bracket 44 is coupled at both sides of the conveying means or band conveyor 11 by means of a respective pivot or link coupling 45 and 46 with the longitudinal or lengthwise extending beams or structural members 16 and 17 of the conveying means or band conveyor 11. The cantilever or bracket 44 together with the carriage 43 thus is positively forced to follow the upward and downward or elevational motion of the conveying means or band conveyor 11.

The cantilever or bracket 44 is provided at both of its ends with upwardly extending support members or support brackets 47 and 48. One end of the associated pivot or link coupling 45 and 46 is attached to these support brackets 47 and 48, respectively. A respective angle lever or bell crank 51 and 52 is connected at pivot shafts or locations 49 and 50 to both brackets 47 and 48, respectively. A respective drive means, for example a friction element in the form of a friction wheel 53 and 54, is rotatably mounted at the end of the longer arm of each associated angle lever or bell crank 51 and 52, respectively. A respective fluid-operated apparatus 55 and 56 which is likewise mounted at the associated support bracket 47 and 48 engage the end of the shorter arm of the related angle lever or bell crank 51 and 52. The fluid-operated apparatuses or units 55 and 56 serve to press the associated friction wheels 53 and 54 against the end or lateral flanges 24 of the winding core or mandrel 22 or against the flat end or lateral sides or end faces of the wound product package 23 formed thereon. Furthermore, as illustrated for example in FIG. 3 in chain dotted lines, the fluid-operated apparatuses 55 and 56 also serve to move the friction wheels 53 and 54 away from one another and to thus release the wound product package 23.

The drive or drive means of the friction wheels 53 and 54 is now described below in relation to FIGS. 1 and 2.

A respective coupling or clutch 57 and 58, for example a slipping or slip clutch, is positioned at both sides of the driven deflection roll or roller 12 of the conveying means or band conveyor 11. One half of each respective coupling or clutch 57 and 58 is fixedly connected for rotation with the deflection roller 12. The other half of the respective coupling or clutch 57 and 58 supports a respective sprocket wheel 59 and 60. A respective chain 61 and 62 leads from the respective sprocket wheels 59 and 60 to respective sprocket wheels 63 and 64.

These sprocket wheels 63 and 64 are rotatably mounted at the hinge point or connection of the respective pivot or link couplings 45 and 46 with the longitudinal beams or structural members 16 and 17, respectively. A further sprocket wheel 65 and 66 is connected with the respective sprocket wheels 63 and 64. A respective chain 67 and 68, which extends substantially parallel to the respective pivot or link couplings 45 and 46, leads from this respective sprocket wheel 65 and 66 to a respective sprocket wheel 69 and 70 which is coaxial to the pivot point or connection of the respective pivot or link coupling 45 and 46 at the respective support brackets 47 and 48.

The respective sprocket wheels 69 and 70 constitute, for instance, the respective drive wheels of a miter or bevel gear train or gearing 71 and 72. Respective power take-off wheels 73 and 74 or the like of this bevel gear train or gearing 71 and 72, respectively, are arranged coaxial to the pivot shafts or pins 49 and 50, respectively, of the respective angle levers or bell cranks 51 and 52 and drive respective chains 75 and 76 or the like. These chains 75 and 76 entrain respective sprocket wheels 77 and 78 which are fixedly connected for rotation to and coaxially with the respective friction wheels 53 and 54.

The transmission or gear ratio of the bevel gear train or gearing 71 and 72 is designed for a peripheral or circumferential speed of the friction wheels 53 and 54 which is approximately as large as or somewhat larger than the peripheral or circumferential speed of the wound product package 23. Since, however, the friction wheels 53 and 54 do not engage at the location of the outermost circumference or periphery of the wound product package 23, this peripheral or circumferential speed is necessarily somewhat less than the peripheral or circumferential speed at the outermost periphery or circumference of the wound product package 23. Consequently, the winding strap or band 21, as previously mentioned, thus moves in a tensioned or taut state with the imbricated stream or formation S as a function of the action of the slipping couplings or clutches 57 and 58. Even with the situation of a large wound product package 23, the speed difference between the circumference of the friction wheels 53 and 54 and the circumference of the wound product package 23 remains small and practically constant since the friction wheels 53 and 54 are continuously located at the contact region of the conveyor means or band conveyor 11 with the circumference of the wound product package 23 in that the friction wheels 53 and 54 appropriately positionally adjustingly follow the increasing size of the wound product package 23 by virtue of the action of the rocker or swinging mechanism 90.

It can be observed from FIG. 1 that the axes of the friction wheels 53 and 54 are continuously located essentially in a radial plane of the wound product package 23. This is true because the guide rail or track 42 assures for a straight line or linear guidance of the elevational or up and down motion of the cantilever or bracket 44, even though the conveying means or band conveyor 11 and thus the longitudinal beams 16 and 17 thereof undergo a pivoting motion or movement. In the embodiment illustrated in FIGS. 1 through 3, the friction wheels 53 and 54 thus transmit a drive action or drive capability which is effective only in the direction of the circumference or periphery of the winding core or mandrel 22 or the wound product package 23 wound thereon. The friction wheels 53 and 54 are therefore each advantageously provided with a respective friction covering or lining 53' and 54' which can be formed similar to a motor vehicle tire or pneumatic tire and may be constituted by an elastically compressable material, for instance an elastomer. The friction wheels 53 and 54 may be each structured as a dished rubber wheel.

If it is desired that a further force component should be effective at the flat front sides or surfaces of the wound product package 23 being formed, in addition to the drive force which is only effective in the direction of the circumference or periphery, for example in order to compact or compress the wound product package 23, then, for instance, the friction wheels 53 and 54 can be given a predetermined or certain so-to-speak "camber" in relation to their point of rolling contact at the lateral sides or end faces of the wound product package 23. In the embodiment under discussion it is only necessary to attach the guide rail or track 42, which in FIG. 1 is attached vertically with respect to the lateral machine frame 31, somewhat inclined or sloping on the lateral machine frame 31.

Figure 4:
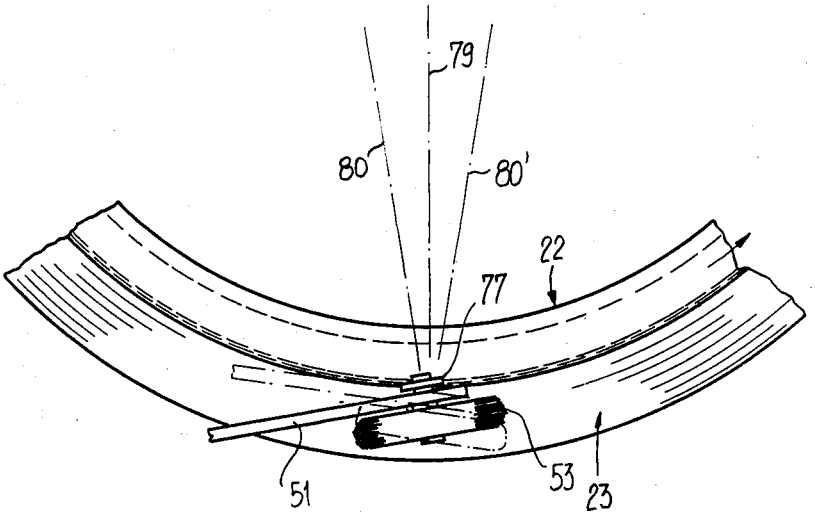
FIG. 4 schematically illustrates a partial section showing that the camber or toe-in or toe-out of the friction wheels can be adjusted or altered.

The situation as schematically illustrated by the solid or full lines in FIG. 4 occurs if this guide rail or track 42 as shown in FIG. 1 is attached at the lateral machine frame 31 after being somewhat rotated in counterclockwise direction. The chain dotted line 79 illustrates the direction of the radius of the wound product package 23 while the chain dotted line 80 illustrates the direction of the shafts or axes of the friction wheels 53 and 54. In this position when the axes of the friction wheels 53 and 54 are in the position illustrated with the chain dotted line 80, the friction wheels 53 and 54, in addition to the force exerted in the direction of the circumference of the wound product package 23,—similar to the gas spring 20—, also exert a force component directed towards the center of the wound product package 23.

On the other hand, the situation as illustrated with the chain dotted line in FIG. 4 in which the chain dotted line 80' indicates the direction of the shafts or axes of the friction wheels 53 and 54 results if the guide rail 42 is attached to the lateral machine frame 31 after being rotated somewhat in a clockwise manner as compared to the position shown in FIG. 1.

Likewise, a change of camber of the friction wheels 53 and 54 could be achieved by mounting the support brackets 47 and 48, upon which the respective bevel gear train or gearing 71 and 72 and the respective fluid-operated mechanisms or units 55 and 56 are mounted somewhat in the one or the other direction about the shafts or axes of the respective sprocket wheels 69 and 70 at the cantilever or bracket 44 or at the carriage 43. In so doing, the guide rail or track 42 still guides the friction wheels 53 and 54 in an exact radial direction with respect to the wound product package 23 in accordance with the increasing size thereof.

Figure 5:
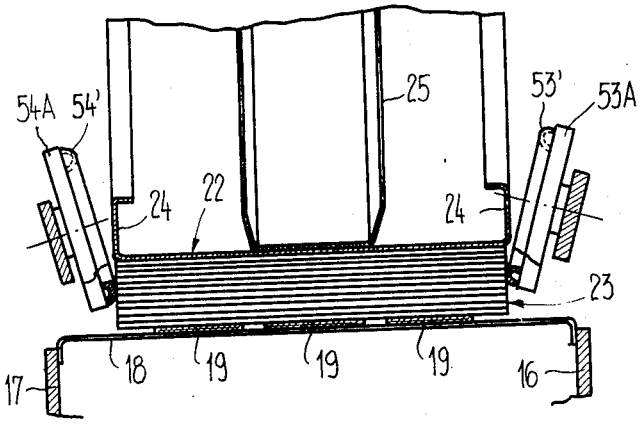
FIG. 5 schematically illustrates an exemplary embodiment of the friction wheels.

FIG. 5 schematically illustrates an exemplary embodiment of the friction wheels. According to this exemplary embodiment, the shafts or axes of the friction wheels 53A and 53A do not intersect the lengthwise axis of the winding core or mandrel 22 at a right angle but intersect at an acute angle. The friction wheels 53A and 54A are therefore each beneficially provided with a frictional or friction covering or lining 53' and 54', respectively, at their circumference at the location of and on their flat side confronting the wound product package 23. Additionally, the point of attack or engaging contact of the friction wheels 53A and 54A with the flat lateral sides or end faces of the wound product package 23 or the winding core end flanges 24, as the case may be, at the side of their wheel shafts or axes which is situated most remote or furthest away from the lengthwise axis of the wound product package 23. A decisive advantage of these friction wheels 53A and 54A is that the drive of the wound product package 23 takes place along a contact arc. This contact arc can be so-to-speak concentric to the wound product package 23 by virtue of the rollability or kneadability of the frictional covering or lining 53' and 54' of the friction wheels 53 and 54, respectively.

Apart from the winding strap or band 21, which is wound up at the package circumference together with incoming imbricated formation or stream S into the wound product package 23, the outer side or surface of the wound product package 23 is untouched. The friction wheels 53 and 54 engage at locations of the products, here the assumed newspapers Z, where there is not present any printing ink. While being wound up, the newspapers Z are only pressed transverse to their flat sides or surfaces by their inherent weight and by the action of the winding band or strap 21, but not by the contact or pressing forces of the friction wheels 53 and 54 required for the drive of the wound product package 23. In addition, the friction wheels 53 and 54 have an equalizing function so that the resulting wound product package 23 contains completely substantially flat or planar end or lateral sides or end faces.

The thus resulting technical success can be seen especially clearly in comparison with the apparatus for winding a plurality of printed sheets as known from the published European Pat. application No. 0,135,080.

In the aforementioned European Pat. application No. 0,135,080, a swinging or rocker mechanism for delivering the aforementioned printed sheets is provided with a conveyor band and an endless drive band engageable with the circumference of the wound product package is provided for driving the wound product package. The conveyor band and the drive band are positionally adjustable or advanceable in the manner of pliers or pincers at approximately diametrically opposed locations on the circumference of the wound product package. The drive band encircles a portion of the circumference of the wound product package while exerting a pressure which is or must be substantial, especially if printed products arriving at a high speed from a rotary printing press are to be wound up. In this case it is not only necessary to form the wound product package while tensioning the winding strap, but the wound product package must be frequently stopped and again accelerated to the operational speed. If this is to be achieved without slippage, the drive or contact band must be held with great force against the circumference of the wound product package. Even if slippage could be avoided, the pressure alone leads to pressure points and smearing or smudging of the printing ink on the printed products to be wound up.

By utilizing friction elements such as friction wheels which engage at the lateral sides or end faces of the wound product package, this danger can be avoided. Surprisingly, the wound product package drive, in spite of the comparatively limited package engagement or contact surface of the friction wheels, is capable of accelerating or stopping the wound product package, which can weigh several tons, within seconds with comparatively low contact pressure or force. Naturally also the proper product winding process can be easily accomplished.

While there are shown and described present preferred embodiments of the invention, it is to be distinctly understood that the invention is not limited thereto, but may be otherwise variously embodied and practiced within the scope of the following claims. Accordingly.

What I claim is:

1. An apparatus for winding a continuously arriving imbricated formation of flexible flat structures, especially folded printed products, into a wound product package having substantially flat end faces, comprising:

a winding core equipped with substantially flat end faces and upon which there are wound the continuously arriving imbricated formation into a wound product package;

a bearing arrangement for rotatably mounting said winding core;

delivery means for substantially tangentially delivering the continuously arriving imbricated formation to said winding core or said wound product package formed thereon along a predeterminate conveying path;

drive means for frictionally driving said wound product package exclusively at the vicinity of its circumference;

said drive means for frictionally driving said wound product package comprising at least one pair of friction wheels;

means for supplying a winding strap which is wound up under tension together with the imbricated formation to form the wound product package; and means for positionally adjusting said at least one pair of friction wheels for engaging at said substantially flat end faces of said winding core or at said substantially flat end faces of said wound product package formed thereon at engagement locations situated substantially axially opposite one another at the vicinity of the circumference of said winding core or at the vicinity of the wound product package formed thereon.

2. The apparatus as defined in claim 1, wherein:

said engagement locations situated axially opposite one another at which said at least one pair of friction wheels engage at said substantially flat end faces of said winding core or at said substantially flat end faces of said wound product package formed thereon are located in a region of a contact point of said conveying path for tangentially delivering the continuously arriving imbricated formation to said wound product package being formed.

3. The apparatus as defined in claim 1, wherein:

each friction wheel of said at least one pair of friction wheels has a circumference; and a friction covering provided at said circumference of each said friction wheel of said at least one pair of friction wheels.

4. The apparatus as defined in claim 3, wherein:

said friction covering is constituted by an elastically compressible material.

5. The apparatus as defined in claim 4, wherein:

said elastically compressible material comprises an elastomer.

6. The apparatus as defined in claim 1, wherein:

said winding core has a lengthwise axis;

each of said at least one pair of friction wheels having an axis of rotation; and said axis of of rotation of each of said at least one pair of friction wheels being located in a plane which is disposed substantially perpendiuclar to said lengthwise axis of said winding core.

7. The apparatus as defined in claim 1, wherein:

said at least one pair of friction wheels is drivingly connected to said delivery means.

8. An apparatus for winding a continuously arriving imbricated formation of flexible flat structures, especially folded printed products, into a wound product package having substantially flat end faces, comprising:

a winding core equipped with substantially flat end faces and upon which there are wound the continuously arriving imbricated formation into a wound product package;

a bearing arrangement for rotatably mounting said winding core;

delivery means for substantially tangentially delivering the continuously arriving imbricated formation to said winding core or said wound product package formed thereon along a predeterminate conveying path;

drive means for frictionally driving said wound product package at the vicinity of its circumference;

said drive means for frictionally driving said wound product package comprising at least one pair of friction wheels;

means for supplying a winding strap which is wound up under tension together with the imbricated formation to form the wound product package;

means for positionally adjusting said at least one pair of friction wheels for engaging at said substantially flat end faces of said winding core or at said substantially flat end faces of said wound product package formed thereon at engagement locations situated substantially axially opposite one another at the vicinity of the circumference of said winding core or at the vicinity of the wound product package formed thereon;

said engagement locations situated axially opposite one another at which said at least one pair of friction wheels engage at said substantially flat end faces of said winding core at said substantially flat end faces of said wound product package formed thereon being located in a region of a contact point of said conveying path for tangentially delivering the continuously arriving imbricated formation to said wound product package being formed;

said delivery means for substantially tangentially delivering the continuously arriving imbricated formation comprising a pivotable rocker band conveyor means;

said winding core having a lengthwise axis;

means for resiliently biasing said pivotable rocker band conveyor means in a direction extending substantially towards said lengthwise axis of said winding core;

supporting means for supporting said at least one pair of friction wheels; and said supporting means being operatively coupled to said delivery means for substantially tangentially delivering the continuously arriving imbricated formation.

9. The apparatus as defined in claim 8, further including:

means for removing said at least one pair of friction wheels from said engagement locations and for releasing said wound product package.

10. The apparatus as defined in claim 9, wherein:

said removing means include means for adjustably setting a predeterminate force which is exerted by said at least one pair of friction wheels at said substantially flat end faces of said wound product package.

11. The apparatus as defined in claim 10, further including:

an angle lever provided for each friction wheel;

each angle lever having two oppositely situated ends;

each friction wheel of said at least one pair of friction wheels being located at one end of a predetermined one of said angle levers;

said supporting means for said at least one pair of friction wheels comprising a respective support for each said friction wheel;

means pivotably mounting each of said angle levers at a respective one of said supports of said supporting means for supporting said at least one pair of friction wheels; and said removing means comprising lifting means for removing each said friction wheel of said at least one pair of friction wheels from said engagement locations and for adjusting said predeterminate force of said at least one pair of friction wheels.

12. The apparatus as defined in claim 11, further including:

at least one respective chain for driving each said friction wheel of said at least one pair of friction wheels;

at least one first sprocket wheel coaxially arranged with respect to each said friction wheel of said at least one pair of friction wheels and fixedly connected for rotation with a respective one of each said friction wheel of said at least one pair of friction wheels;

at least one second sprocket wheel coaxially arranged with respect to a pivot axis of a respective one of said angle levers; and each said at least one respective chain being guided over said at least one first sprocket wheel and said at least one second sprocket wheel.

13. The apparatus as defined in claim 12, further including:

drive means for driving said delivery means for substantially tangentially delivering the continuously arriving imbricated formation;

slipping clutch means cooperating with said drive means for said delivery means;

said friction wheels for frictionally driving said wound product package receiving driving power for said friction wheels from said drive means for driving said delivery means by means of said slipping clutch means;

bevel gearing means provided for each friction wheel;

said at least one second sprocket wheel for each friction wheel constituting a drive wheel of said bevel gearing means thereof;

a chain drive provided for each friction wheel; and said drive wheel of said bevel gearing means being driven by means of said chain drive from said slipping clutch of the associated friction wheel.

14. The apparatus as defined in claim 13, wherein:

each said friction wheel of said at least one pair of friction wheels has a predetermined camber; and means for adjusting and fixing said predetermined camber in relation to the direction of rotation at said engagement location of each said friction wheel of said at least one pair of friction wheels.

15. The apparatus as defined in claim 12, wherein:

each friction wheel has an axis of rotation;

said axis of rotation of each friction wheel of said at least one pair of friction wheels and said lengthwise axis of said winding core lie substantially in a plane; and said axis of rotation of each said friction wheel of said at least one pair of friction wheels intersecting said lengthwise axis of said winding core at an acute angle.

16. The apparatus as defined in claim 15, wherein:

each of said engagement locations of each of said friction wheels is located on a neighboring flat end face of said wound product package at a location on the circumference of each said friction wheel situated furthest removed from said lengthwise axis of said winding core.

17. The apparatus as defined in claim 16, wherein:

each friction wheel of said at least one pair of frictional wheels is structured as a dished rubber wheel.

18. The apparatus as defined in claim 8, further including:

a displaceably mounted guide carriage;

said supporting means for supporting each friction wheel of said at least one pair of friction wheels being mounted at said displaceably mounted guide carriage;

at least one link coupling means provided for each friction wheel; and said displaceably mounted guide carriage being connected by means of said link coupling means with said delivery means for substantially tangentially delivering the continuously arriving imbricated formation.

19. An apparatus for winding a continuously arriving imbricated formation of flexible flat structures, especially folded printed products, into a wound product package having substantially flat end faces, comprising:

a winding core equipped with substantiallyl flat end faces and upon which there are wound the continuously arriving imbricated formation into a wound product package;

a bearing arrangement for rotatably mounting said winding core;

delivery means for substantially tangentially delivering the continuously arriving imbricated formation to said winding core or said wound product package formed thereon along a predeterminate conveying path;

drive means for frictionally driving said wound product package at the vicinity of its circumference;

said drive means for frictionally driving said wound product package comprising at least one pair of friction wheels;

means for supplying a winding strap which is wound up under tension together with the imbricated formation to form the wound product package;

means for positionally adjusting said at least one pair of friction wheels for engaging at said substantially flat end faces of said winding core or at said substantially flat end faces of said wound product package formed thereon at engagement locations situated substantially axially opposite one another at the vicinity of the circumference of said winding core or at the vicinity of the wound product package formed thereon;

drive means for driving said delivery means for substantially tangentially delivering the continuously arriving imbricated formation;

slipping clutch means cooperating with said drive means for said delivery means; and said friction wheel for frictionally driving said wound product package receiving driving power for said friction wheels from said drive means for driving said deleivery means by means of said slipping clutch means.

20. An apparatus for winding a continuously arriving imbricated formation of flexible flat structures, especially folded prined products, into a wound product package having substantially flat end faces, comprising:

a winding core equipped with substantially flat end faces and upon which there are the continuously arriving imbricated formation into a wound product package;

a bearing arrangement for rotatably mounting said winding core;

delivery means for substantially tangentially delivering the continuously arriving imbricated formation to said winding core or said wound product package formed thereon along a predeterminate conveying path;

drive means for frictionally driving said wound product package at the vicinity of its circumference;

said drive means for frictionally driving said wound product package comprising at least one pair of friction wheels;

means for supplying a winding strap which is wound up under tension together with the imbricated formation to form the wound product package;

means for positionally adjusting said at least one pair of friction wheels for engaging at said substantially flat end faces of said winding core at said substantially flat end faces of said wound product package formed thereon at engagement locations situated substantially axiallly opposite one another at the vicinity of the circumference of said winding core or at the vicinity of the wound product package formed thereon;

each friction wheel of said at least one pair of friction wheels having a circumference;

a friction covering provided at said circumference of each said friction wheel of said at least one pair of friction wheels;

said friction covering being constituted by an elastically compressible material;

said elastically compressible material comprising an elastomer; and said elastically compressible material being configured in the form of a pneumatic tire.

21. An apparatus for winding a continuously arriving imbricated formation of flexible flat structures, especially folded printed products, into a wound product package having substantially flat end faces, comprising:

a winding core equipped with substantially flat end faces and upon which there are wound the continuously arriving imbricated formation into a wound product package;

a bearing arrangement for rotatably mounting said winding core;

delivery means for substantially tangentially delivering the continuously arriving imbricated formation to said winding core or said wound product package formed thereon along a predeterminate conveying path;

drive means for frictionally driving said wound product package at the vicinity of its circumference;

said drive means for frictionally driving said wound product package comprising at least one pair of friction wheels;

means for supplying a winding strap which is wound up under tension together with the imbricated formation to form the wound product package;

means for positionally adjusting said at least one pair of friction wheels for engageing at said substantially flat end faces of said winding core or at said substantially flat end faces of said wound product package formed thereon at engagement locations situated substantially axially opposite one another at the vicinity of the wound product package formed thereon; and said drive means for frictionally driving said at least one pair of friction wheels containing slipping clutch means.

22. An apparatus for winding a continuously arriving imbricated formation of flexible flat structures, especially folded printed products, together with a tensioned winding strap into a wound product package having substantially flat end faces, comprising:

a winding core equipped with substantially flat end faces and upon which there are wound the continuously arriving imbricated formation into a wound product package;

means for rotatably mounting said winding core;

means for substantially tangentially delivering the continuously arriving imbricated formation to said winding core or said wound product package formed thereon;

drive means for frictionally driving said wound product package exclusively at the region of its circumference;

said drive means for frictionally driving said wound product package comprising at least one pair of friction wheels; and means for selectively positioning said at least one pair of friction wheels for engaging at said substantially flat end faces of said winding core or at said substantially flat end faces of said wound product package formed thereon at engagement locations situated substantially opposite one another.

* * * * *